US010471306B2

(12) United States Patent
Ngah

(10) Patent No.: US 10,471,306 B2
(45) Date of Patent: Nov. 12, 2019

(54) SAFETY DEVICE FOR CLIMBING ACTIVITIES AND A CORRESPONDING METHOD

(71) Applicant: CLIMB ASIA PTE LTD, Singapore (SG)

(72) Inventor: Mohammad Halil Bin Ngah, Singapore (SG)

(73) Assignee: CLIMB ASIA PTE LTD, Singapore (SG)

( * ) Notice: Subject to any disclaimer, the term of this patent is extended or adjusted under 35 U.S.C. 154(b) by 264 days.

(21) Appl. No.: 15/312,640

(22) PCT Filed: Jun. 30, 2015

(86) PCT No.: PCT/SG2015/050189
§ 371 (c)(1),
(2) Date: Nov. 19, 2016

(87) PCT Pub. No.: WO2016/003369
PCT Pub. Date: Jan. 7, 2016

(65) Prior Publication Data

US 2017/0203158 A1 Jul. 20, 2017

(30) Foreign Application Priority Data

Jun. 30, 2014 (SG) ..... 10201403740Q

(51) Int. Cl.
*A63B 29/02* (2006.01)
*B66D 3/10* (2006.01)

(52) U.S. Cl.
CPC ..... *A63B 29/02* (2013.01); *B66D 3/10* (2013.01)

(58) Field of Classification Search
CPC .... A62B 1/06; A62B 1/08; A62B 1/10; A63B 29/02; B66D 3/04; B66D 3/046; B66D 3/06; B66D 3/08; B66D 3/10
See application file for complete search history.

(56) References Cited

U.S. PATENT DOCUMENTS 252,829 A * 1/1882 Williams ..... A62B 1/14 188/65.3
573,739 A * 12/1896 Wethered ..... A62B 1/06 182/191

(Continued)

FOREIGN PATENT DOCUMENTS

EP 0694317 A2 1/1996
JP 6099271 A 6/1985

OTHER PUBLICATIONS

International Search Report and Written Opinion of PCT/SG2015/050189.

*Primary Examiner* — Sang K Kim
*Assistant Examiner* — Nathaniel L Adams
(74) *Attorney, Agent, or Firm* — Joseph G. Chu; JCIP

(57) ABSTRACT

There is provided a safety device for climbing activities usable with a rope. The device comprises a first pulley mounted to a base plate, the first pulley being configured to engage a first portion of the rope; a second pulley mounted to the base plate, the second pulley being configured to engage a second portion of the rope, the second portion of the rope being downstream of the first portion; and a third pulley mounted to the base plate, the third pulley being configured to guide a third portion of the rope, the third portion being between the first portion and the second portion. It is advantageous that a position of at least one of the first, the second and the third pulley at the base plate can be varied. A corresponding method is also provided.

6 Claims, 3 Drawing Sheets

(56) References Cited

U.S. PATENT DOCUMENTS

| | | | | |
|---|---|---|---|---|
| 4,114,726 | A * | 9/1978 | Sentinella | A62B 1/06 182/5 |
| 2006/0207829 | A1 | 9/2006 | Mauthner | |
| 2006/0289235 | A1 * | 12/2006 | Chen | A62B 1/14 182/192 |
| 2012/0193166 | A1 | 8/2012 | Rogelja | |

* cited by examiner

SAFETY DEVICE FOR CLIMBING ACTIVITIES AND A CORRESPONDING METHOD

FIELD OF INVENTION

The present application relates to a safety device for climbing activities and a corresponding method.

BACKGROUND

Rock climbing and other climbing activities typically involve use of a safety rope set-up. The safety rope set-up typically includes tying one end of a rope to a climber, with a second end of the rope being passed through an anchor point at/around a highest position of a climbing surface, before the second end is passed through a belay device and held by a person designated to ensure safety of the climber.

The belay devices currently in use in the market rely on various techniques to increase a frictional force applied to a rope passing through the belay devices. These techniques include, for example, increasing a contact surface between the device and the rope, using a camming action on the ropes and so forth.

However, the belay devices currently in the market require users to have prior training and/or experience to vary the frictional force being applied to the rope passing through the belay devices. This is undesirable as each of the belay devices is only able to handle specific climber weight categories and not able to handle a plurality of climber weight categories.

Most belay devices also rely on an attendant (belayer) holding the rope at all times. The climber risks "free-falling" to the ground should the belayer deliberately/accidentally/unwittingly release the rope, thus compromising the safety of the climber. This is most undesirable.

SUMMARY

In a first aspect, there is provided a safety device for climbing activities usable with a rope. The device comprises a first pulley mounted to a base plate, the first pulley being configured to engage a first portion of the rope; a second pulley mounted to the base plate, the second pulley being configured to engage a second portion of the rope, the second portion of the rope being downstream of the first portion; and a third pulley mounted to the base plate, the third pulley being configured to guide a third portion of the rope, the third portion being between the first portion and the second portion. It is advantageous that a position of at least one of the first, the second and the third pulley at the base plate can be varied.

The safety device can further comprise a top plate, the top plate being configured to be mounted to the base plate, and a plurality of metal spacers configured to maintain a predetermined distance between the base plate and the top plate, with at least one of the plurality of metal spacers being configured to guide the rope, and at least one of the plurality of metal spacers being configured to act as a mounting point for the safety device.

It is preferable that at least one of the first, second and third pulleys includes at least one sprag clutch.

In a second aspect, there is provided a method of varying a mode of a safety device for climbing activities usable with a rope including a plurality of pulleys, the method comprising varying a position of at least one of the pulleys within the safety device to vary a resistance of the safety device.

DESCRIPTION OF FIGURES

In order that the present invention may be fully understood and readily put into practical effect, there shall now be described by way of non-limitative example only preferred embodiments of the present invention, the description being with reference to the accompanying illustrative figures.

DESCRIPTION OF PREFERRED EMBODIMENTS

There is provided a safety device with multiple modes, and includes redundancy in the device in case of component failure within the device. The safety device is an essential tool for ensuring safety of climbers engaging in climbing activities.

Figure 1:
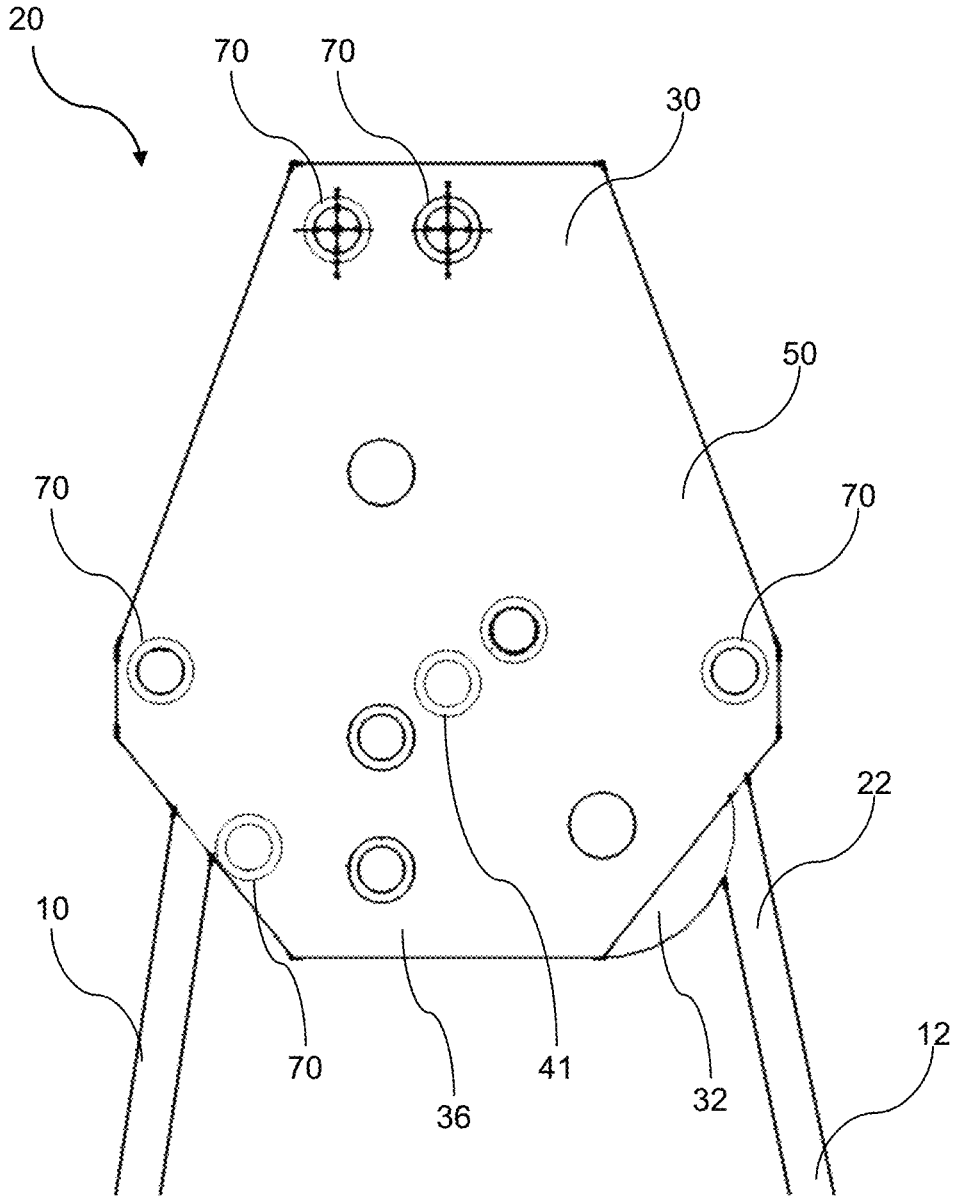
FIG. 1 shows an external view of the safety device of the present invention.
Figure 2:
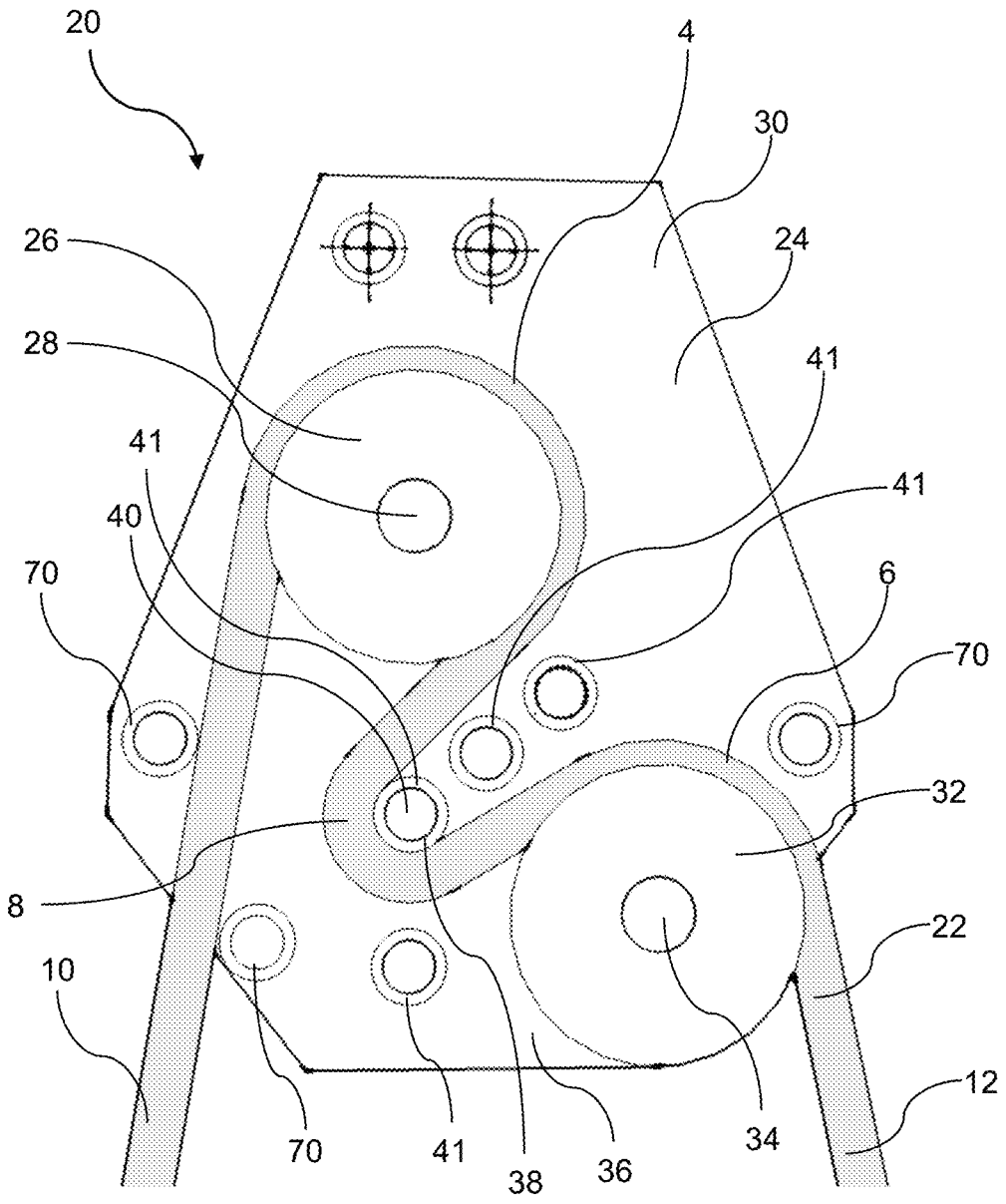
FIG. 2 shows a cross sectional view of the safety device of FIG. 1.
Figure 3:
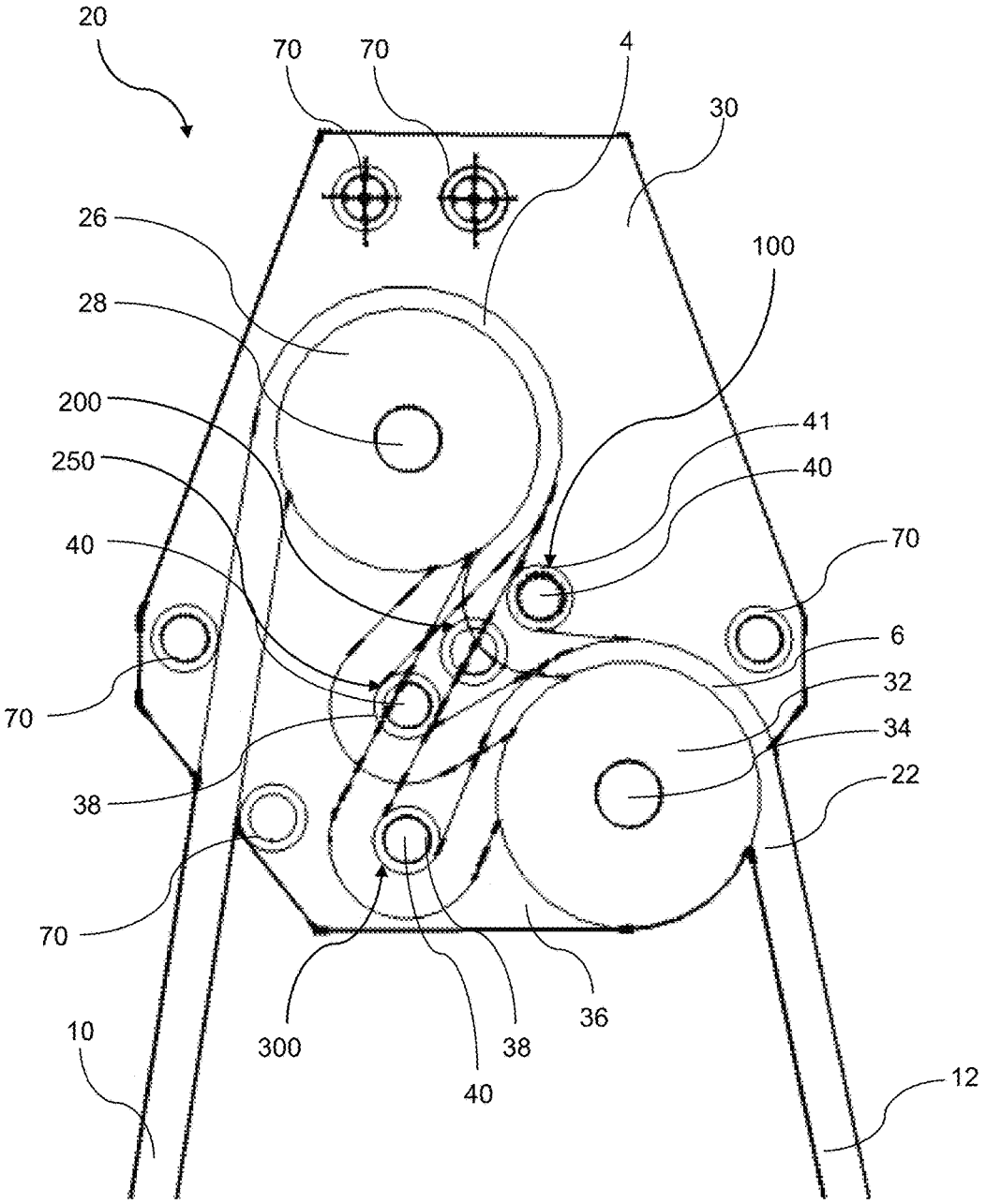
FIG. 3 shows a cross sectional view of a plurality of modes of the safety device of FIG. 1.

Referring to FIGS. 1 to 3, there is provided a safety device 20 for climbing activities. The device 20 is usable with a rope 22. During use of the safety device 20, a first end 10 of the rope 22 is secured to a climber, while a second end 12 of the rope 22 is held by an attendant to ensure the safety of the climber.

The device 20 includes a base plate 24 made of a metal alloy such as, for example, steel and aluminum alloys of a thickness of at least 3 mm which is able to withstand a load of more than 20 KN before breaking. The base plate 24 is configured provide a structure for the safety device 20 to conform to BS-EN standards for artificial climbing structures.

The device 20 includes a first pulley 26 configured to guide the rope 22 (the first pulley 26 engages a first portion 4 of the rope 22), whereby a first axle 28 of the first pulley 26 is mounted to an upper portion 30 of the base plate 24. There is also a second pulley 32 configured to guide the rope 22 (the second pulley 32 engages a second portion 6 of the rope 22), whereby a second axle 34 of the second pulley 32 is mounted to a lower portion 36 of the base plate 24.

The device 20 also includes a third pulley 38 configured to guide the rope 22 (the third pulley 38 engages a third portion 8 of the rope 22), whereby a third axle 40 of the third pulley 38 is mounted to the base plate 24. The third axle 40 can be removably mounted to the base plate 24. It should be noted that the second portion 6 of the rope 22 is downstream to the first portion 4 of the rope 22, and the third portion 8 of the rope 22 is between the first portion 4 and the second portion 6.

An amount of friction between the rope 22 and each of the pulleys 26, 32, 38 varies according to, for example, rope construction, diameter of rope, whether the rope is new/used and so forth. For the sake of clarity, the rope 22 being described in the specification is of consistent type and dimensions.

It should be noted that each of the first 26, second 32 and third pulleys 38 can include at least one sprag clutch (one-way bearing) which allows rotation of the first 26, second 32 and third pulleys 38 in only a single direction. It should be appreciated that the first 26 and second 32 pulleys are configured to rotate in an opposite direction to the third pulley 38. It should also be noted that even though a diameter of the third pulley 38 is shown in FIGS. 2 and 3 to be less than respective diameters of the first 26 and the second 32 pulleys, it is not a mandatory requirement for the safety device 20. Sprag clutches in the respective pulleys 26, 32, 38 eliminate a possibility of total clutch failure. About 50% of friction between the rope 22 and the pulleys 26, 32, 38 would still be available in the event of failure of any one of the sprag clutches in the respective pulleys 26, 32, 38.

The safety device 20 can also comprise a top plate 50, whereby the top plate 50 is configured to be mounted to the base plate 24 so as to cover the rope 22 and the pulleys 26, 32, 38. The top plate 50 is configured to prevent disengagement of the rope 22 from any of the pulleys 26, 32, 38. There is also a plurality of metal spacers 70 configured to maintain a pre-determined distance between the base plate 24 and the top plate 50. Depending on location, at least one of the plurality of metal spacers 70 is can be configured to guide the rope 22 and can also be configured to be a mounting point for the safety device 20.

A position of the third pulley 38 on the base plate 24 can be varied to vary a mode of the safety device 20. Referring to FIG. 3, when the third pulley 38 is at a first position 100, the rope 22 undergoes minimal deflection and the attendant holding onto the second end 12 of the rope 22 expends maximum effort to hold or lower the climber. When the third pulley 38 is at the first position 100, the safety device 20 is in a "low resistance" mode. When the third pulley 38 is at a second position 200, the rope 22 undergoes moderate deflection and the attendant holding onto the second end 12 of the rope 22 expends less effort to hold or lower the climber compared to when the third pulley 38 is at the first position 100. When the third pulley 38 is at the second position 200, the safety device 20 is in a "mid resistance" mode. It should be appreciated that the "mid resistance mode" is typically a default mode for the safety device 20. When the third pulley 38 is at a third position 250, the rope 22 undergoes close-to-maximum deflection and the attendant holding onto the second end 12 of the rope 22 expends even less effort to hold or lower the climber compared to when the third pulley 38 is at the second position 200. When the third pulley 38 is at the third position 250, the safety device 20 is in a "close-to-max resistance" mode. When the third pulley 38 is at a fourth position 300, the rope 22 undergoes maximum deflection and the attendant holding onto the second end 12 of the rope 22 expends least effort to hold or lower the climber. When the third pulley 38 is at the fourth position 300, the safety device 20 is in a "max resistance" mode. While only four modes of the safety device 20 are described, it can be possible to have more modes.

For the sake of clarity, the following scenarios are also helpful with regard to explaining use of the various modes of the safety device 20.

In a first scenario, when novices take up the sport of indoor rock climbing, the safety device 20 would be configured in a "mid resistance" mode as both the climbers and attendants lack the requisite experience.

In a second scenario, whenever new ropes are used with the safety device 20, the safety device 20 would also be configured in a "max resistance" mode as new ropes often come with a shiny coating which is slightly slippery and typically generate less friction with the pulleys 26, 32, 38.

In a third scenario, whenever ropes wear out (after one to three months of moderate usage), they typically "fatten" and becomes "furry" on the sheath. This causes friction between the rope 22 and the pulleys 26, 32, 38 to increase with lighter climbers usually experiencing difficulty getting back to the ground due to the very high friction. The safety device 20 should now be configured to "mid resistance" mode.

In a fourth scenario, when the safety device 20 is used at a facility that caters to only trained/experienced climbers, the safety device 20 is configured to the "low resistance" mode so the attendants get minimum assistance as another belay device is typically deployed in a series arrangement (this is as per training for outdoors climbing where belaying technique and its mastery is crucial in ensuring climber safety). When in the "low resistance" mode, the safety device 20 only intervenes to safely lower the climber in the event of attendant oversight/error.

It should be appreciated that the mode of the safety device 20 can be determined either by weight limits or by age limits. A climbing wall in a kindergarten or primary school will generally have users below a certain age and below a certain weight. Further, children below the age of eight also typically have limited motor skills, so their ability to climb is limited and belaying is typically only for children above the age of twelve. A climbing wall in a general sports/recreational club would normally be for users above a certain weight and age.

It should be noted that the position of the third pulley 38 can be varied either by removing the axle 40 and moving the third pulley 38 to a desired position at axle placement holders 41 without removing the top plate 50, or by sliding the third pulley 38 using slots incorporated within the safety device 20. It should be appreciated that there are four axle placement holders 41 shown in FIGS. 2 and 3 (ie at first location 100, second location 200, third location 250 and fourth location 300).

It should be appreciated while the preceding description only describes re-positioning of the third pulley 38, it is also possible for any of the first 26 and second 32 pulleys to be re-positioned on the base plate 24. It is evident that re-positioning of any of the first 26 and second 32 pulleys would also enable varying a mode of the safety device 20 in the manner as described in the preceding paragraphs.

It should be noted that use of the safety device 20 enhances safety for climbers given that multiple pulleys are used, and the various modes of the safety device 20 can be easily varied by changing a position of the third pulley 38.

Whilst there have been described in the foregoing description preferred embodiments of the present invention, it will be understood by those skilled in the technology concerned that many variations or modifications in details of design or construction may be made without departing from the present invention.

The invention claimed is:

1. A safety device for climbing activities usable with a rope, the device comprising:

a first pulley mounted to a base plate, the first pulley being configured to engage a first portion of the rope;

a second pulley mounted to the base plate, the second pulley being configured to engage a second portion of the rope, the second portion of the rope being downstream of the first portion; and a third pulley mounted to the base plate, the third pulley being configured to guide a third portion of the rope, the third portion being between the first portion and the second portion, wherein each of the first, second, and third pulleys is fixed at a predefined position at the base plate, wherein the respective predefined position of at least one of the first, second, and third pulleys at the base plate can be varied between a plurality of predefined discrete positions at the base plate before the rope is engaged with the pulleys; and wherein when the device is in use, the pulleys are fixed at the respective predefined positions.

2. The safety device of claim 1, further comprising a top plate, the top plate being configured to be mounted to the base plate.

3. The safety device of claim 1, wherein at least one of the first, second, and third pulleys includes at least one sprag clutch.

4. The safety device of claim 1, further comprising a plurality of metal spacers configured to maintain a predetermined distance between the base plate and the top plate.

5. The safety device of claim 4, wherein at least one of the plurality of metal spacers is configured to guide the rope to engage with the pulleys.

6. The safety device of claim 4, wherein at least one of the plurality of metal spacers is configured to act as a mounting point for the safety device.

* * * * *